United States Patent [19]

Porzel

[11] 4,286,708

[45] Sep. 1, 1981

[54] MODULE TO PREVENT SYMPATHETIC DETONATIONS IN MUNITIONS

[75] Inventor: Francis B. Porzel, Falls Church, Va.

[73] Assignee: The United States of America as represented by the Secretary of the Navy, Washington, D.C.

[21] Appl. No.: 68,355

[22] Filed: Aug. 21, 1979

[51] Int. Cl.[3] ..... B65D 81/08; B65D 85/30; F42B 37/00; F42B 39/00

[52] U.S. Cl. ..... 206/3; 206/443; 206/593

[58] Field of Search ..... 206/3, 591, 443, 593

[56] References Cited

U.S. PATENT DOCUMENTS

| | | | |
|---|---|---|---|
| 2,420,663 | 5/1947 | Heath et al. | 206/3 |
| 2,514,364 | 7/1950 | Bates | 206/3 |
| 2,792,962 | 5/1957 | Granfelt | 206/3 |
| 4,055,247 | 10/1977 | Benedick et al. | 206/591 |
| 4,222,484 | 9/1980 | Howe | 206/3 |

*Primary Examiner*—William T. Dixson, Jr.
*Attorney, Agent, or Firm*—R. S. Sciascia; A. L. Branning; J. C. LaPrade

[57] ABSTRACT

The sympathetic or chain reaction detonation of stacked munitions is prevented by confining any random explosion essentially to a single explosive unit or container. Frangible inhibitor plates are located between adjacent munitions, such as artillery shells, so as to isolate the adjacent explosive units from a residual shock wave or case fragment that would otherwise trigger sympathetic detonation. The inhibitor plates may be constructed as part of a container in which an artillery shell may be stored, or the plates may be separately inserted between any adjacent warhead in any conventional storage pallet or transporting configuration. The plates are designed to absorb only that amount of explosive energy required to prevent sympathetic detonation, without requiring that the explosive forces be redirected away from adjacent shells, thus reducing the problem of redirected blast.

31 Claims, 8 Drawing Figures

MODULE TO PREVENT SYMPATHETIC DETONATIONS IN MUNITIONS

BACKGROUND OF THE INVENTION

The present invention relates generally to improvements in explosion containment, and more particularly pertains to an explosion containment device for stored explosives.

One of the more critical problems confronting developers of explosion containment devices has been redirected blast pressure. In Dill, U.S. Pat. No. 2,818,808 and Neal, U.S. Pat. No. 2,655,619, acoustical reflection plates or barriers are used between shaped charges so as to reduce the magnitude of the pressure wave traveling from one charge to the other upon the detonation of one of the charges. Recognizing that any explosion generates a pressure wave which travels out from the center of the explosion in all directions, any part of a pressure wave which is redirected, as through the use of a reflection plate, combines with the unredirected portions of the pressure wave to create an even greater pressure in a direction away from the reflection plate. This redirected, vastly increased pressure wave may create an even greater problem than the sympathetic detonation of other explosive units within the same area. In fact, redirected blast pressure from a single artillery shell may be much more devastating than the combined blast pressure of a plurality of artillery shells which are simultaneously detonated but whose blast pressure wave is unconfined. In effect then, the solving of one problem has created another equally perplexing and potentially more serious problem.

Another method of packaging explosive units so as to prevent sympathetic detonations is illustrated in Banta, U.S. Pat. No. 3,757,933, which discloses a box containing a plurality of hollow tubes with explosive units slidably set within the tubes. Frangible areas are carried by portions of two opposite walls of the box proximate the ends of the tubes, so as to permit a rapid release of the redirected explosive gases generated upon a single premature detonation. In this way, the adjacent explosive units are isolated from residual shock waves that would otherwise trigger sympathetic detonations, but the problem of redirected blast pressure is not solved. With such a device, great care must be taken to insure that areas which may be subjected to the redirected blast pressure are not used for storage of explosive units or other damageable materials.

While the aforementioned patents all rely upon steel members which by sheer strength are used to redirect blast pressure away from adjacent explosive units, thus ignoring the problem of redirected blast pressure, other prior art systems have attempted to deal both with the problem of sympathetic detonation and redirected blast pressure. For example, Benedick et al, U.S. Pat. No. 4,055,247 and Tabor, U.S. Pat. No. 3,786,956, disclose systems directed to the containment of individual explosive units in storage containers which are designed to both absorb and contain the blast, fragments and detonation products from a possible detonation of a contained explosive. Both of these systems rely upon very large bulky containers which are designed to be elastic in nature and which stretch and expand upon detonation, thereby reducing the momentum of the detonation products and high velocity fragments. Of course, containers of these types cannot be used with conventional artillery shell storage means, such as when artillery shells are loaded and stored on pallets. Use of such containment devices are totally impractical in military field operations due to the large number of vehicles that would be required to transport even a minimal number of artillery shells, as well as the amount of time which would be required to extricate an artillery shell from one of these containers and the amount of storage space which would be required to store a sufficient number of shells.

SUMMARY OF THE INVENTION

Accordingly, the instant invention is directed to the providing of an explosion containment means that has all the advantages of similarly employed prior art devices and has none of the above described disadvantages. To obtain this, the present invention provides for the use of energy absorbing steel inhibitor plates, inserted between adjacent explosive units, which are designed to shatter upon the detonation of a single explosive unit and to travel with the pressure wave that is generated by the explosion. The plates may be inserted after the explosive units are already stored in pallets or in some other type of containers, or the plates may be integrally constructed with storage containers prior to the insertion of the explosive units. The plates may comprise single frangible plates of steel shaped to meet the needs and configuration of a particular type of storage container, or the inhibitor plates may comprise a plurality of steel strips attached together in a laminated structure by some conventional means, such as by gluing, welding, etc., which will separate and scatter upon the premature detonation of an explosive unit.

OBJECTS OF THE INVENTION

It is therefore an object of the present invention to mutually isolate explosive units so as to prevent sympathetic detonation.

It is another object of the present invention to provide for shipping a plurality of explosive units within a single container without the danger of sympathetic detonation.

It is a further object of the present invention to substantially eliminate redirected blast pressure associated with the shielding of explosive units from each other.

It is yet another object of the present invention to provide for lightweight, portable sympathetic detonation prevention devices.

Still another object of the invention is to substantially reduce the amount of shielding required between explosive units in order to reduce the probability of sympathetic detonations.

Other objects and many of the attendant advantages of this invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
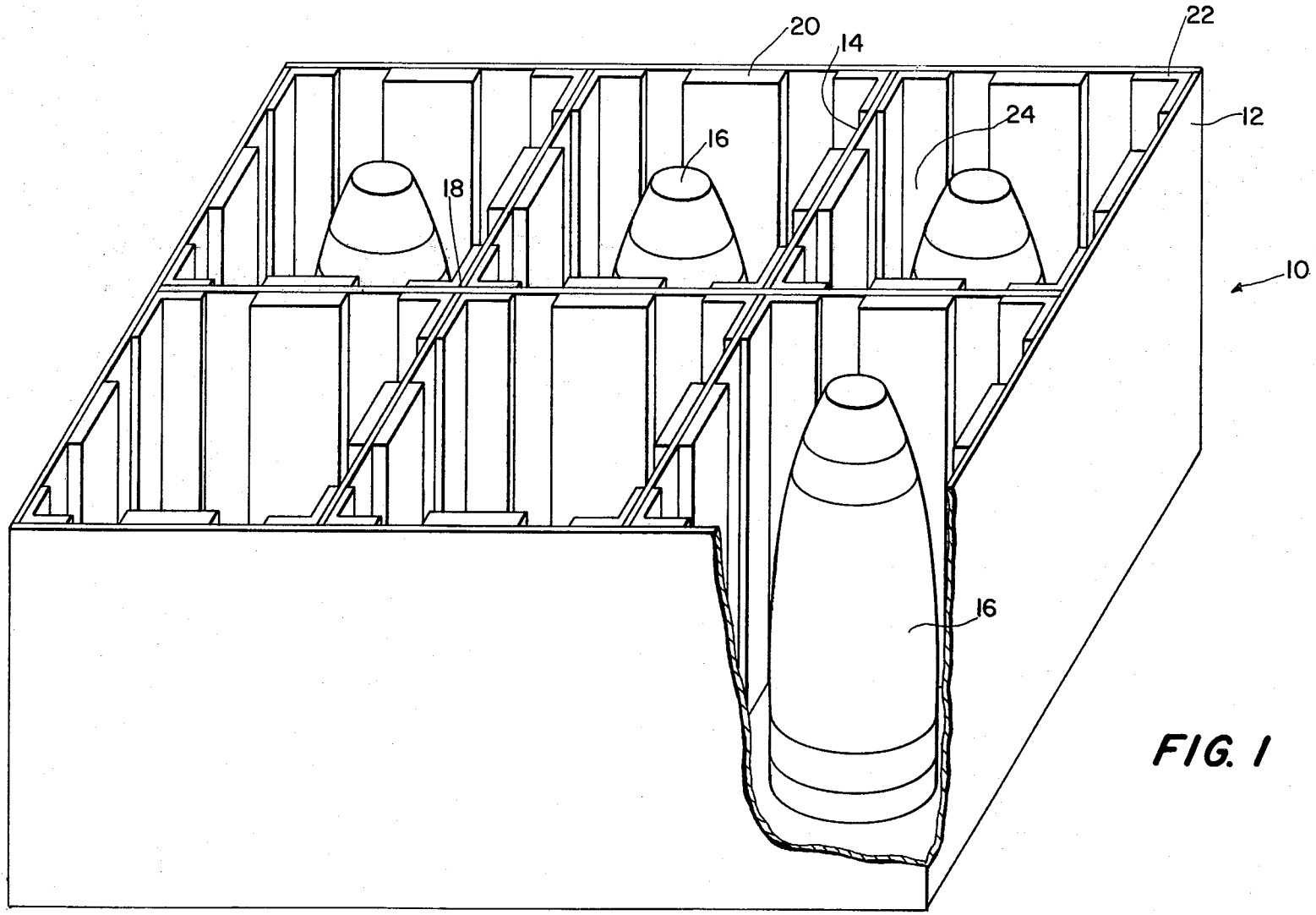
FIG. 1 is an isometric perspective view, partly in section, of a preferred embodiment of the present invention.

FIG. 1, which illustrates a preferred embodiment of the explosive containment device of the present invention, shows a storage container 10 which is used for packaging a plurality of explosive units 16. The container 10 comprises a rectangularly-shaped pallet 12 having four sides and a bottom. The interior of the rectangularly-shaped pallet 12 is divided into a plurality of modules or storage cells 24 through the use of walls or partitions 14. The partitions 14 serve as separators between explosive units 16 which are contained within the pallet 12. Depending upon the number of storage cells 24 desired, any number of intersections 18 between individual partitions 14 may be provided for. Container 10 may be typically constructed of wood, plastic or metal, while explosive units 16 might typically comprise 76 mm artillery shells, Mk 16 torpedoes, 5"/54 projectiles or hand grenades. The explosive unit container 10 thus far described is conventional in nature and is well known in the art.

Figure 2:
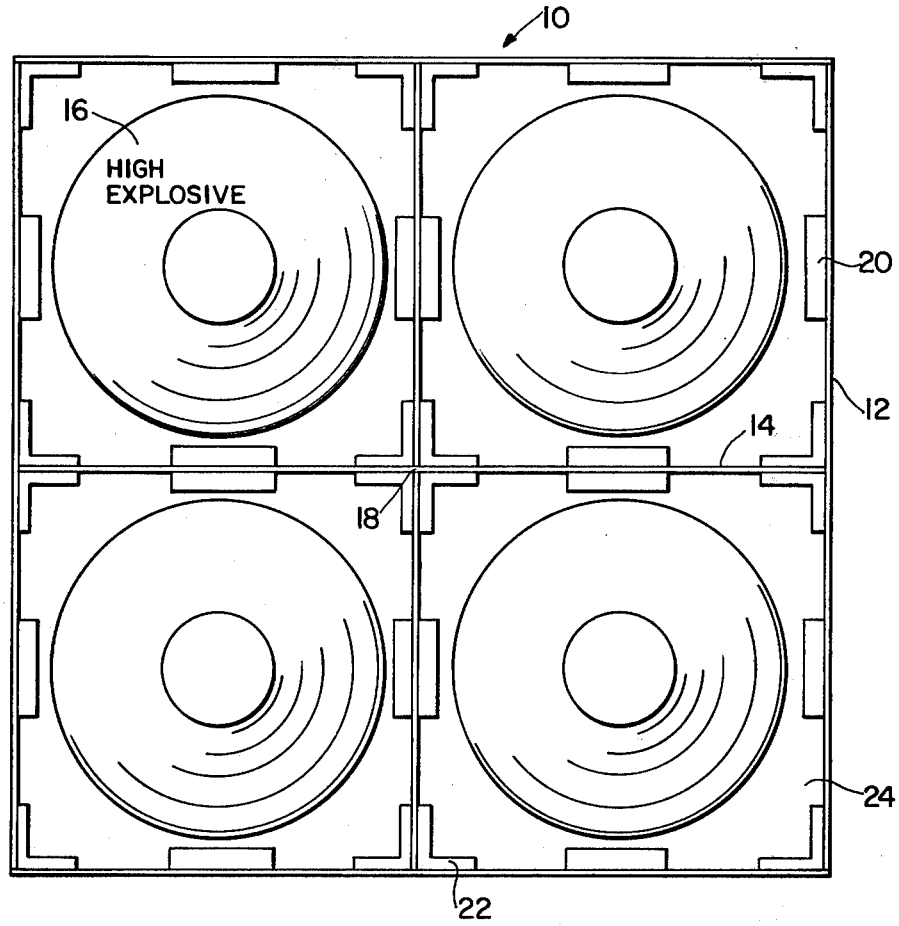
FIG. 2 illustrates a top plan view of the apparatus shown in FIG. 1.

The present invention recognizes the importance of utilizing container 10 as a means for preventing sympathetic detonations, as well as for the storage of explosive units 16. Such a use of container 10 is accomplished through the insertion of flat plates 20 and L-shaped plates 22 into the pallet 12. As shown in both FIGS. 1 and 2, each explosive unit 16 is encircled by four flat plates 20 arranged so that one plate is located on each of the four walls 14 of the individual storage cell 24 containing the particular explosive unit. As is clearly shown in FIG. 2, the plates 20 are arranged so that one plate is located on each of the four interior walls 14 and midway between the corners thereof of any particular storage cell 24. Located intermediate the plates 20 and in each of the four corners of the same cells 24 are L-shaped plates 22. In effect then, each explosive unit 16 is surrounded by a minimum of four flat plates 20 and four L-shaped plates 22 arranged as shown in FIG. 2. The plates 20, 22 are arranged so that at least one plate is present between all adjacently located explosive units 16. As can be recognized, differently shaped pallets might well require a varying number of differently shaped inhibitor plates.

Figure 3:
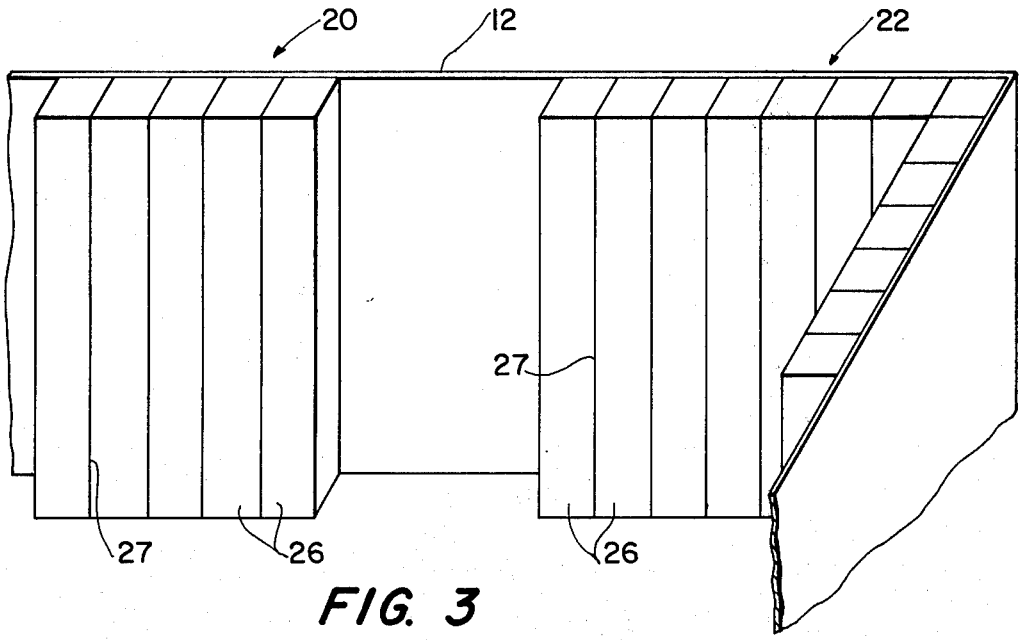
FIG. 3 is a cutaway isometric view of the reinforced container of FIG. 1.

FIG. 3 more clearly illustrates the construction of the flat plates 20 and the L-shaped plates 22 as shown in the embodiment of FIG. 1. As illustrated, both plates 20 and 22 may be constructed of a plurality of metallic strips 26, preferably steel, although many other materials may function equally well. The strips 26 are bonded together by some conventional means, e.g., glue, solder, etc., to form a laminated structure. While the plates 20 and 22 maybe of a laminated design as shown in FIG. 3, both the flat and L-shaped plates may in the alternative consist of a single, integral piece of formed steel provided that the plates are not so thick as to render them infrangible to the blast pressure generated by a detonated explosive unit 16.

While in the preferred embodiment of FIG. 1, the plates 20, 22 have been shown as being securely and integrally connected to the interior walls 14 of the individual storage cells 24, an alternative embodiment envisions the use of such plates in a portable manner. In other words, the plates 20 and 22 could be separately manufactured and later inserted manually into the storage cells 24 of conventional explosive unit containers 10. Such manual insertion might include the use of some adhesive means, such as glue, to securely attach the plates 20, 22 to the walls 14 of the pallet 12, or in the case of a tight fit, the plates might need only be frictionally attached within the storage cells 24. The only requirements are that the plates 20, 22 be located between adjacent explosive units 16 and that some means be provided to prevent the plates from moving out of their position between the explosives.

The essence of the design of the plates 20, 22 was derived from experiments based on the Unified Theory of Explosions (UTE). UTE provides a simple comprehensive way to predict and evaluate the blast from virtually any explosion. The technology base includes sympathetic detonation determinations and the prediction of fragment sizes, distribution, trajectories, density and residual energy or impact.

UTE teaches that sympathetic detonation may be caused by direct shock, fragment impact, cook off, translational impact or radiation (laser, x-rays, etc.). Sympathetic detonation is far too complex to expect precise, rigorous solutions in every case, and is far too broad in scope to risk descriptions which apply well to other than only specialized situations. Accordingly, the UTE approach was followed with respect to the present invention.

With reference to sympathetic detonation, UTE recognizes that energy density is the controlling variable. Sympathetic detonation is not unique to pressure, or to temperature as cook off might suggest, or to velocity of fragment impact, to differentiation of the explosive or to translational impact. It may result from any one or all of these causes, the common denominator being energy density. UTE also recognizes that some critical energy density must exist below which the explosive will never detonate regardless of how long it is exposed to thermal or mechanical stresses. If the source detonation is too brief or the impacting fragment too small, the detonation pressure wave will die out, however intense the stimulus may be. This theory is born out by the fact that cosmic rays and particles bombard explosives innumerable times a second with vastly greater energy density than is necessary to initiate an explosion locally, yet they do nothing to the explosive as a whole, except perhaps to "age" it. Also under certain conditions, effects appear to be cumulative, i.e., synergistic. For example, if explosives are exposed to fire, they appear to become more sensitive to pressure and much smaller impacts will set them off. Less widely known, but well established from tests is the observation that the energy release from an explosion is a function of the input energy. Up to the point of detonation, low impact velocity produces a small explosion, while high impact velocities produce large explosion energies. The reaction may die out for purely chemical reasons, and/or many mechanical reasons, such as physical breakup of the explosive charge in the complex geometry of the impact. Once a full detonation is achieved, it is evidently more than enought to initiate another explosion. So, at high enough impact energies, the explosion pressure wave becomes self-sustaining and the energy release is no longer a function of the impacting energy.

Figure 4:
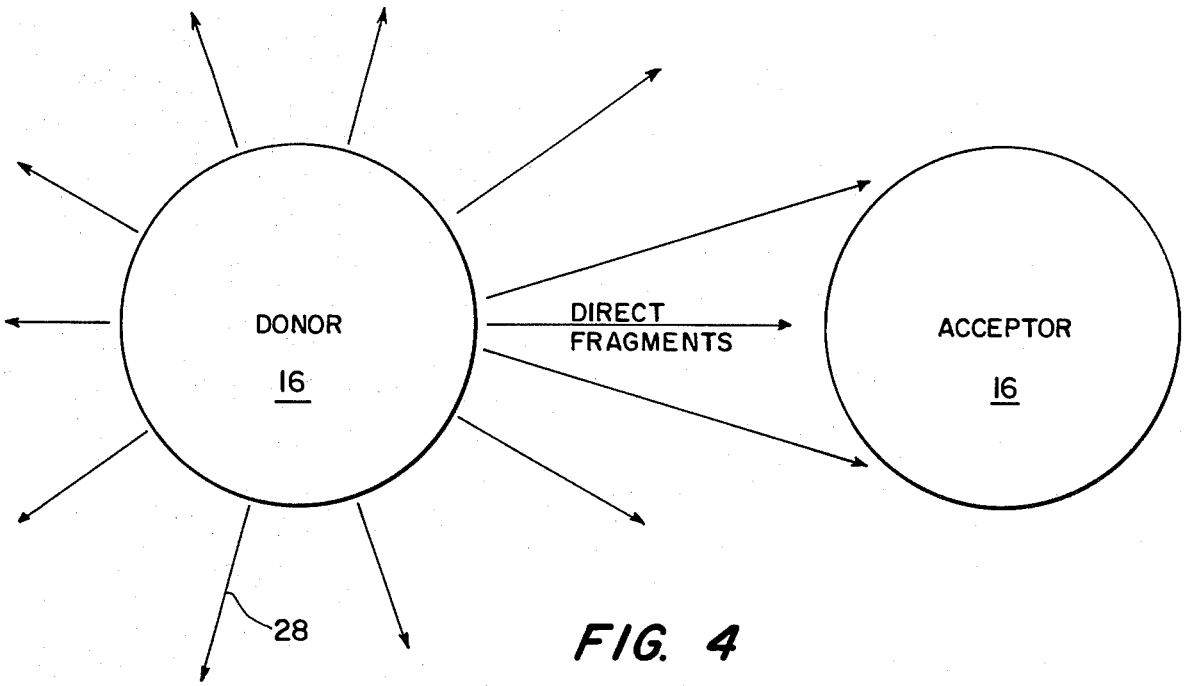
FIG. 4 is a diagrammatic depiction of the blast effect associated with a detonated explosive unit.

FIG. 4 shows two explosive units 16 adjacent each other, one of which is designated the donor and having rays 28 radiating outwardly therefrom, such rays being representative of the pressure wave associated with the detonation of the donor. The other explosive unit 16 is designated the acceptor and is representative of an explosive unit which must absorb the pressure wave generated by the donor.

Figure 5:
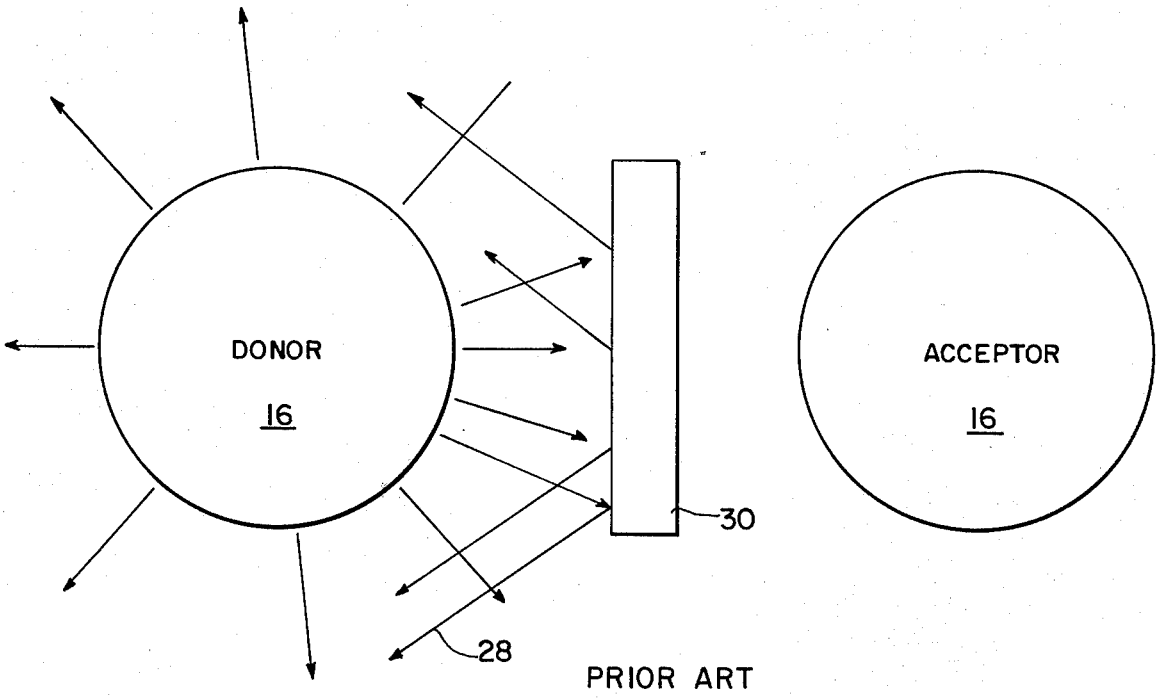
PRIOR ART FIG. 5
FIG. 5 is a diagrammatic illustration of the redirected blast effect associated with the use of a prior art detonation containment means.

With the rays 28 also being representative of the direct shock, fragment impact, cook off, translational impact and radiation with which the acceptor must deal, and more particularly being representative of the energy density which is synergistically present, reference is next made to FIG. 5 which shows acceptor and donor explosive units 16 separated by a prior art shielding plate 30. The reflection of rays 28 off of the infrangible plate 30 illustrates the problems which may result from redirected blast pressure. In effect, the reflected rays 28 combine with other unreflected rays to create a much more forceful pressure wave in the unshielded directions. It is this represented redirected blast pressure that has caused so many problems in the art and with which the present invention effectively deals.

Figure 6:
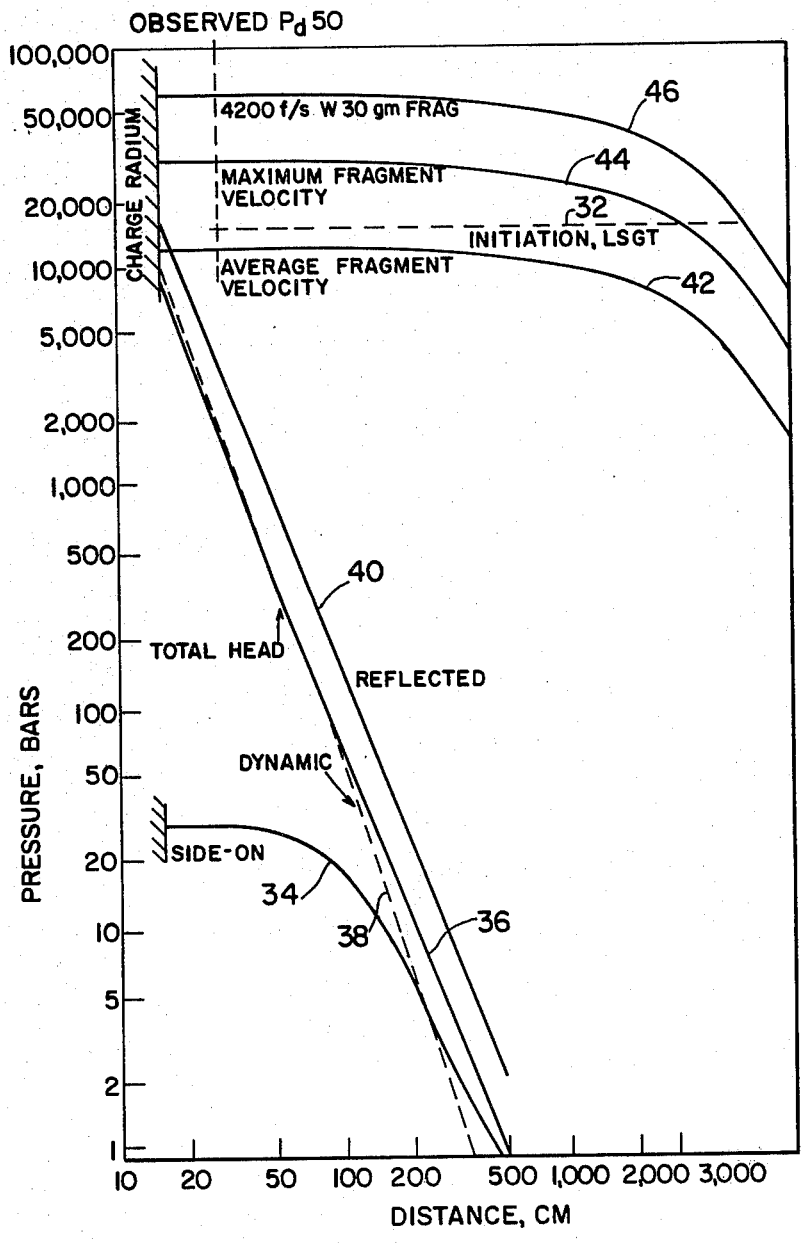
FIG. 6 is a graph of the pressures required to initiate sympathetic detonation.

With an understanding of redirected blast pressure, reference is next made to FIG. 6 to assist in the understanding of the present invention. The graph in FIG. 6 shows which variables are capable of causing detonation between neighboring 5 inch/54 artillery shells. Shown are the pressure-distance curves as were calculated through the use of the unified theory of explosions (UTE) for a five inch/54 shell loaded with 7.8 pounds of composition A-3 explosive. Near the top of the graph is a horizontal line 32 at a pressure of 16 kilobars which is the initiation detonation pressure of explosive A-3 as determined by prior test. This line 32 is the "bottom line" for sympathetic detonation, i.e., sympathetic detonation can only occur at pressures above 16 kilobars. Far below the line 32, with a maximum pressure of 32 bars, is the side-on blast pressure line 34. It is too small in order of magnitude to cause detonation in an adjacent round. The total pressure head 36 is produced mostly by the dynamic pressure (dashed line) 38 of the debris from the explosive products, and includes the average value of the fragments' energy. When the total head 36 strikes another explosive, it produces the reflected pressure 40 as shown. From the graph, it can be determined that the reflected pressure 40 is not sufficient to cause direct shock detonation of an adjacent artillery round for one more perhaps a few centimeters distant.

With respect to the upper three full lines as shown on the graph, line 42 represents the average fragment velocity pressure, line 44 represents the maximum fragment velocity pressure and line 46 represents the pressure associated with a 30 gram fragment traveling at the rate of 42 hundred feet per second. These three lines 42, 44, 46 show the pressures induced locally by typical fragments from a 5 inch/54 projectile. As can be determined from the graph, the average fragment with an impact pressure of 13 kilobars is too slow to cause detonation. The fastest fragments which are possible can cause detonation of bare A-3 explosive out to a considerable distance, about 30 meters, before drag forces set in to lower the impact velocity. But when an isolated fragment from a donor strikes an acceptor, it must share its momentum with the acceptor shell case, reducing the average velocity by a typical factor of two, bringing it below the detonation initiation pressure.

The overall conclusions from FIG. 6 are that direct shock is not likely to cause sympathetic detonation of 5"/54 composition A-3 loaded shells, single small fragments are incapable of producing detonation in 5"/54 shells loaded with A-3, and the cumulative effect of multiple impacts from closely spaced small fragments is required to induce detonation in these artillery shells. Most importantly, the calculations depicted in graphical form by FIG. 6 suggest that the probability of sympathetic detonations of 5"/54 shells with A-3 is marginal at best and as such, the detonations could be readily defeated with modest amounts of shielding. Similar calculations can readily be made for other warheads having different types of explosive compositions through the use of UTE.

Guided by the model defined in FIG. 6 and being concerned only with fragment initiation and not blast initiation, three processes for inhibiting sympathetic detonation from fragments were incorporated in achieving the design of the present invention. Firstly, the process of absorption was considered. By means of the large scale gap test (LSGT), as described in Naval Ordnance Laboratory Test Report 74-40, evidence was obtained that sympathetic detonation might be inhibited simply by imposing a thickness of an absorber (like plastic cards) between the donor and the acceptor. Moreover, the results of the large scale gap test provided a good indicator as to the amount of absorber which might be required. The large scale gap test suggested that about 2.5 inches of plastic was required to inhibit detonation of A-3 in the confinement and geometry provided by the test. The equivalent mass of a dense material (but poorer absorber) like steel is provided by a steel plate about 0.3 inches thick. This is a first guess as to the thickness of steel required. These inhibitor or absorber thicknesses would hold, provided the attenuation was a matter of momentum transfer by a smooth planar shock or by single fragments. For the 5"/54, the donor case does not provide the absorber thickness required because it transmits the high reflected pressure it produced in the explosive and is later driven by the impulse of the explosive debris. However, the acceptor case is an attenuator. To a first approximation, the attenuation offered by the shell case is somewhat offset by the reflection and multiple impact processes. A fact which is made very clear from the pressure-distance curve in FIG. 6 is that fragments are a way of concentrating energy well above what the smooth shock wave can produce.

The second process considered was the one of standoff which provides a way to capitalize on the inherent divergence from any spherical or cylindrical explosion merely because the fragments move outwardly on radial lines. Divergence is the reason for the first and most obvious thing to know about explosions, i.e., the farther away, the better. As is clear from standoff theory, a given size inhibitor plate will apparently increase in effectiveness as it is placed farther from the donor simply because it subtends less momentum and energy then it would suffer at the closer distance. Standoff or divergence is the crux of the question why detonation pressure occurs at short distance for some munitions. For other munitions, sympathetic detonation may be a matter of fragment energy and single fragment size. In summation, UTE calculations, arena tests and single impact tests agree that typical fragments from any 5"/54 shell are too weak to detonate another projectile. Multiple impacts are required and their cumulative effect can fall off sharply at short distances because of divergence or standoff.

Figure 7:
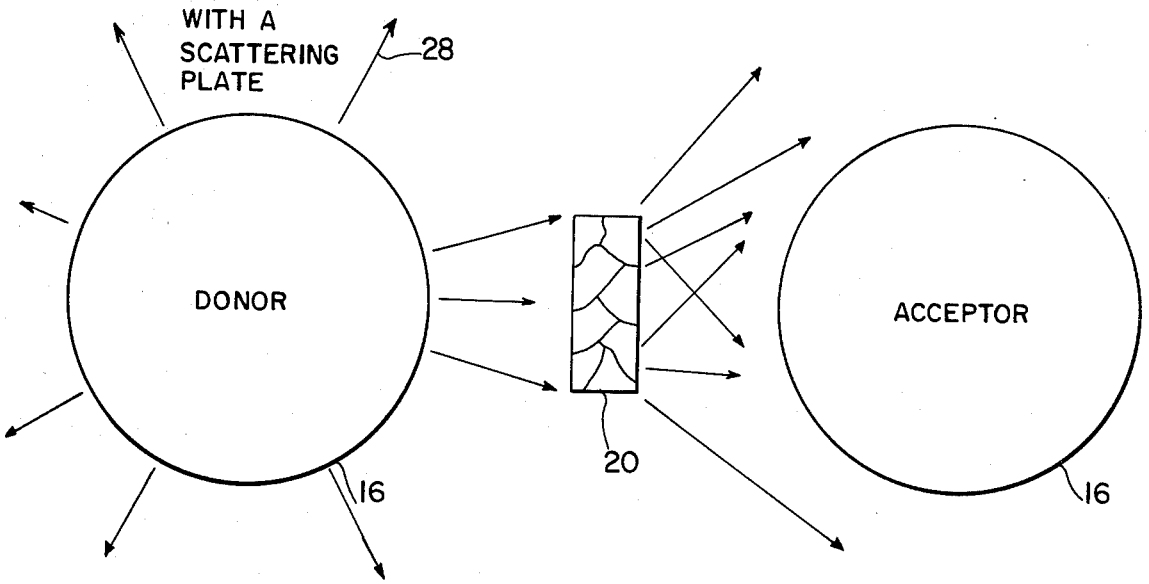
FIG. 7 is a diagrammatic representation of how the present invention prevents sympathetic detonation.

The third and last process considered in the design of the present invention was the one of scattering. Scattering refers to the reflection of fragments out of the beam of fragments traveling along radial lines. It is similar to the way photons are scattered without being absorbed by a thin translucent stream, or by fog. The outgoing fragments from a shell case move radially outwardly as depicted by the rays 28 in FIG. 4. But upon striking a scattering medium, such as the present invention inhibitor plate 20 as depicted in FIG. 7, they diverge outwardly from the original solid angle of the beam within which they were contained. This is a powerful method, provided that the scatter is not too wide, otherwise it begins to scatter as many fragments back into the beam as were scattered out.

Figure 8:
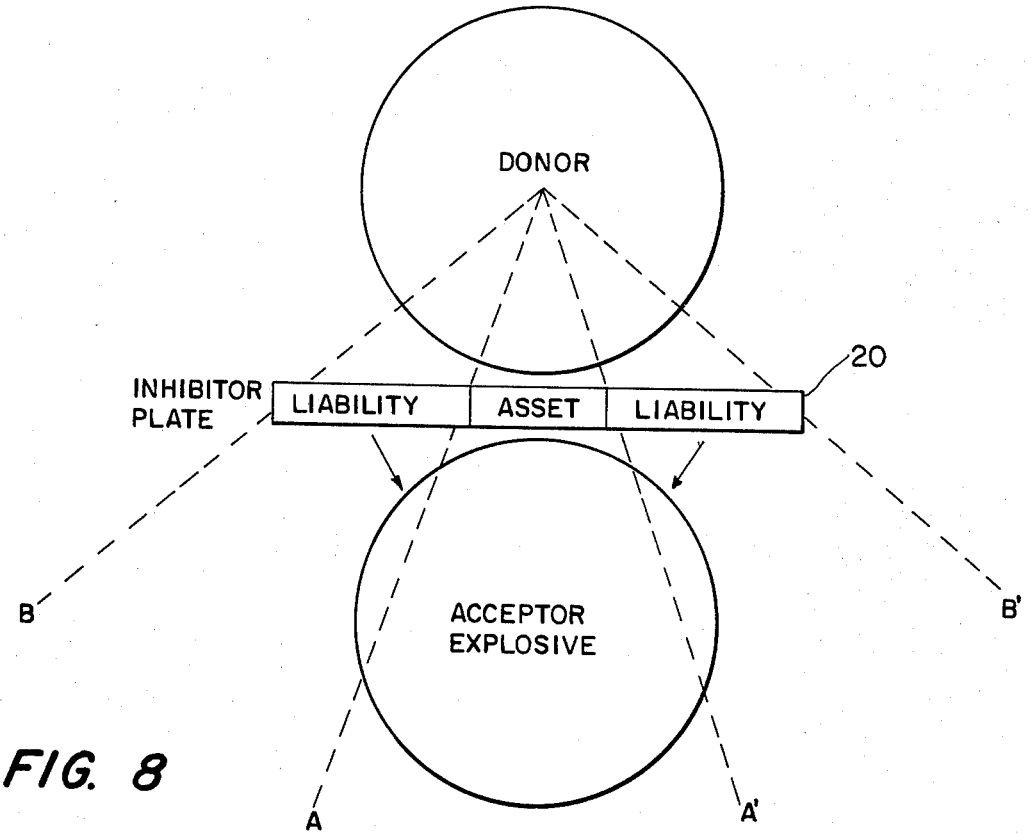
FIG. 8 is an illustration of the scattering theory associated with the present invention.

FIG. 8 is provided to clarify the scattering theory. Specifically, an inhibitor plate 20 is shown positioned between donor and acceptor explosives. The desirable width of the plate is appropriately labelled "assest" while those portions of the plate which would defect the scattering effect due to their making the scatterer too wide are labelled "liability". In effect, an inhibitor plate 20 should be no wider than necessary.

These three processes for absorption of the energy required to cause sympathetic detonation have been incorporated into the design of the present invention. The intent is to put individual rounds in modules (like a milk carton) or storage cells 24 with minimum size inhibitors 20, 22 which are placed only where needed. The inhibitor plates 20, 22 absorb the momentum and energy from the donor, as well as stiffen the module walls 14. The plates 20, 22 are as thin as necessary to save weight and are as narrow as possible in order to maximize scattering. Nothing can be done to exploit standoff, of course, if the shells are to be placed within a standard pallet 12. The module 24 itself or the pallet 12 spacing does provide an important air gap between the donor and the acceptor. This gap allows a rarefaction to develop between each interface so that the momentum is the only means for transmitting the action from one shell to the next. Finally, the module or storage cell 24 serves two other purposes. One is the protection against cookoff since the thin partition or wall 14 is an excellent thermal insulator. The other is that the modules or storage cells 24 being square can readily be banded together in any size pallets 12 of their own.

Hence, it is seen that an effective means of eliminating sympathetic detonations resulting from an explosive shock wave is obtained.

Obviously many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. An explosive unit storage means comprising:

at least one storage cell for storing an explosive unit therein;

at least one frangible sympathetic detonation prevention means proximate to said storage cell, whereby the pressure wave generated by a detonation of an explosive unit contained within said storage cell will be reduced in kinetic energy upon passing through said prevention means and thereby will lack sufficient energy to detonate any adjacently located explosive unit, wherein the detonation prevention means comprises at least one carrier element extending across the opening between explosive units and an energy absorption means supported by the said carrier element.

2. The explosive unit storage means of claim 1, whereby said at least one storage cell comprises at least one wall, said frangible sympathetic detonation prevention means being proximate said wall, said wall extending beyond at least two edges of said frangible sympathetic detonation prevention means.

3. The explosive unit storage means of claim 1, whereby said at least one storage cell comprises at least one wall, said frangible sympathetic detonation prevention means being integral with said wall.

4. An explosive unit storage means comprising:

a plurality of storage cells for storing explosive units therein;

at least one frangible sympathetic detonation prevention means positioned between at last two of said plurality of storage cells, whereby the pressure wave generated by a detonation of an explosive unit contained within said storage cells will be reduced in kinetic energy upon passing through said sympathetic detonation prevention means and thereby will lack sufficient energy to detonate any adjacently located explosive, wherein the detonation prevention means comprises at least one carrier element extending across the opening between explosive units and an energy absorption means supported by the said carrier element.

5. The explosive unit storage means of claim 4, whereby said storage means include at least one partition located between adjacent storage cells, said partition serving as a divider between said cells and having said at least one frangible sympathetic detonation prevention means proximate thereto.

6. The explosive unit storage means of claim 5, whereby said partition comprises a common wall between said storage cells.

7. The explosive unit storage means of claim 5, whereby said at least one frangible sympathetic detonation prevention means is integral with said at least one partition.

8. The explosive unit storage means of claim 5, whereby said frangible sympathetic detonation prevention means is located midway between the edges of said partition, said partition edges extending beyond at least two edges of said frangible sympathetic detonation prevention means.

9. The explosive unit storage means of claim 4, whereby said storage cells comprise a plurality of walls, adjacently located storage cells having in common at least one of said plurality of walls, said frangible sympathetic detonation prevention means being located proximate at least one common wall.

10. The explosive unit storage means of claim 4, whereby said storage cells are box-shaped having four walls, adjacent storage cells having in common at least one of said four walls, said frangible sympathetic detonation prevention means being located proximate said at last one common wall.

11. The explosive unit storage means of claim 4, whereby said storage cells are box-shaped having four walls, said at least one frangible sympathetic detonation prevention means being located proximate the junction of two of said four walls.

12. The explosive unit storage means of claims 9, 10 or 11, whereby said at least one frangile sympathetic detonation prevention means is formed integral with at least one wall of said storage cells.

13. An explosive unit storage means comprising:

at least one explosive unit storage cell, said cell being box-shaped having four walls;

at least one rectangular frangible sympathetic detonation prevention means being located on one of the four walls of said cell, wherein the detonation prevention means comprises at least one carrier element extending across the opening between explosive units and an energy absorption means supported by the said carrier element.

14. An explosive unit storage means comprising:

at least one explosive unit storage cell, said cell being box-shaped having four walls;

at least one L-shaped frangible sympathetic detonation prevention means being located at the juncture of two of the four walls of said at least one storage cell.

15. The explosive unit storage means of claim 13 and further comprising:

at least one L-shaped frangible sympathetic detonation prevention means positioned at the juncture of two of the four walls of said at least one storage cell.

16. The explosive unit storage means of claim 15, wherein said rectangular and said L-shaped frangible sympathetic detonation prevention means are separable from said walls.

17. The explosive unit storage means of claim 15, wherein said rectangular and said L-shaped frangible sympathetic detonation prevention means are integral with said walls.

18. A frangible sympathetic detonation prevention means comprising:

an energy absorption means insertable between adjacently stored explosive units, said absorption means allowing at least part of the pressure wave generated by the detonation of any explosive unit to pass therethrough.

19. The frangible sympathetic detonation prevention means of claim 18, whereby said energy absorption means comprises an frangible flat, rectangular plate.

20. The frangible sympathetic detonation prevention means of claim 18, whereby said energy absorption means comprises a frangible L-shaped plate.

21. The frangible sympathetic detonation prevention means of claim 18, whereby said absorption means comprises at least two plates located in an abutting relationship.

22. The frangible sympathetic detonation prevention means of claim 21, whereby said at least two plates are fixably attached to each other.

23. The frangible sympathetic detonation prevention means of claim 18, whereby said absorption means is frangible, wherein the pressure wave created by the detonation of an explosive unit will shatter said absoprtion means.

24. The frangible sympathetic detonation prevention means of claims 20 or 21, whereby said absorption means permits said pressure wave to pass therethrough by said at least two plates separating from each other.

25. The explosive unit storage means of claim 1 wherein the carrier element comprises a wire support element and the energy absorption means comprises a panel member that covers only part of the area of the opening between explosive units.

26. The explosive unit storage means of claim 1 wherein the frangible sympathetic detonation prevention means comprises a thin wall metal plate.

27. The explosive unit storage means of claim 26 wherein the sympathetic detonation prevention means comprises a thin wall steel plate having a thickness varying from about $\frac{1}{4}$ in to $\frac{3}{4}$ inch.

28. The sympathetic detonation prevention means of claim 26 wherein the metal plate is L-shaped in cross section.

29. The explosive unit storage means of claim 1 wherein the energy absorption means is a thin wall metal plate that is positioned between two adjacent explosive units by a carrier means.

30. The explosive unit storage means of claim 29 wherein the carrier means is further defined as a pair of brackets.

31. The explosive unit storage means of claim 29 wherein the carrier means is further defined as a single wire.

* * * * *